US010975855B2

(12) United States Patent
Campbell et al.

(10) Patent No.: US 10,975,855 B2
(45) Date of Patent: Apr. 13, 2021

(54) FLUID PUMP INCLUDING A PRESSURE OSCILLATION WITH AT LEAST ONE NODAL DIAMETER

(75) Inventors: Andrew Robert Campbell, Cambridge (GB); Justin Rorke Buckland, Cambridge (GB)

(73) Assignee: THE TECHNOLOGY PARTNERSHIP PLC., Royston (GB)

( * ) Notice: Subject to any disclaimer, the term of this patent is extended or adjusted under 35 U.S.C. 154(b) by 1377 days.

(21) Appl. No.: 13/983,472

(22) PCT Filed: Feb. 3, 2012

(86) PCT No.: PCT/GB2012/050227

§ 371 (c)(1),
(2), (4) Date: Nov. 6, 2013

(87) PCT Pub. No.: WO2012/104648

PCT Pub. Date: Aug. 9, 2012

(65) Prior Publication Data

US 2014/0050604 A1 Feb. 20, 2014

(30) Foreign Application Priority Data

Feb. 3, 2011 (GB) ..... 1101870

(51) Int. Cl.
*F04B 43/04* (2006.01)
*F04B 19/00* (2006.01)
(Continued)

(52) U.S. Cl.
CPC ..... *F04B 43/046* (2013.01); *F04B 19/006* (2013.01); *F04B 45/047* (2013.01); *F04F 7/00* (2013.01)

(58) Field of Classification Search
CPC ..... F04B 19/006; F04B 43/04; F04B 43/043; F04B 43/046; F04B 43/095
(Continued)

(56) References Cited

U.S. PATENT DOCUMENTS 3,745,384 A * 7/1973 Blanchard ..... G01L 9/0022 310/324
5,961,298 A 10/1999 Bar-Cohen et al.
(Continued)

FOREIGN PATENT DOCUMENTS

EP 1529963 5/2005
EP 1952992 8/2008
(Continued)

*Primary Examiner* — Charles G Freay
*Assistant Examiner* — Chirag Jariwala
(74) *Attorney, Agent, or Firm* — Tarolli, Sundheim, Covell & Tummino LLP

(57) ABSTRACT

A pump comprising a side wall closed at each end by an end wall forming a cavity for, in use, containing a fluid, one or more actuators each operatively associated with one or more of the end walls to cause an oscillatory motion of the associated end wall(s) whereby, in use, these axial oscillations of the end wall(s) drive substantially radial oscillations of the fluid pressure in the cavity, two or more apertures in the cavity, a valve disposed in at least one of the apertures, wherein the actuator(s) is arranged to be non-axisymmetric in use such that, in use, a pressure oscillation with at least one nodal diameter is generated within the cavity.

18 Claims, 10 Drawing Sheets

(51) Int. Cl.
*F04F 7/00* (2006.01)
*F04B 45/047* (2006.01)

(58) Field of Classification Search
USPC ..... 417/412, 413.1, 413.2, 479, 413.3, 322
See application file for complete search history.

(56) References Cited

U.S. PATENT DOCUMENTS 6,079,214 A 6/2000 Bishop
6,227,824 B1 5/2001 Stehr
6,672,847 B2 * 1/2004 Dooley ..... F04B 43/09 417/394
7,424,827 B2 * 9/2008 Yamada ..... G01N 29/045 73/579
8,123,502 B2 * 2/2012 Blakey et al. ..... F04B 43/046 417/413.1
2003/0124006 A1 7/2003 Dooley
2009/0087323 A1 * 4/2009 Blakey et al. ..... F04B 43/046 417/413.2
2009/0104056 A1 * 4/2009 Miyazawa ..... B41J 2/17596 417/413.2
2010/0310398 A1 * 12/2010 Janse Van Rensburg ..... F04F 7/00 417/488
2011/0280755 A1 * 11/2011 Wackerle et al. ..... F04B 43/04 417/559

FOREIGN PATENT DOCUMENTS

WO 2006111755 10/2006
WO 2009112866 9/2009
WO WO 2009112866 A1 * 9/2009 ..... F04B 43/046
WO 2009122340 10/2009
WO 2010139916 12/2010
WO 2010139918 12/2010
WO 2011095795 8/2011

* cited by examiner

FLUID PUMP INCLUDING A PRESSURE OSCILLATION WITH AT LEAST ONE NODAL DIAMETER

BACKGROUND OF THE INVENTION

Field of the Invention

The illustrative embodiments of the invention relate generally to a pump for fluid and, more specifically, to a pump having a substantially disc-shaped cavity with substantially circular end walls and a side wall and a valve for controlling the flow of fluid through the pump.

Description of Related Art

The generation of high amplitude pressure oscillations in closed cavities has received significant attention in the field of pump type compressors. Recent developments have allowed the generation of pressure waves with higher amplitudes than previously thought possible.

It is known to use acoustic resonance to achieve fluid pumping from defined inlets and outlets. This can be achieved using a cylindrical cavity with an actuator at one end, which drives an acoustic standing wave. In such a cylindrical cavity, the acoustic pressure wave has limited amplitude. Varying cross-section cavities, such as cone, horn-cone and bulb have been used to achieve high amplitude pressure oscillations thereby significantly increasing the pumping effect. In such high amplitude waves the non-linear mechanisms of energy dissipation have been suppressed. However, high amplitude acoustic resonance has not been employed within disc-shaped cavities in which radial pressure oscillations are excited until recently. Patent applications WO2006/111775, WO2009/112866, PCT/GB2009/050613, and PCT/GB2009/050615 disclose pumps having substantially disc shaped cavities with high aspect ratios (i.e. the ratio of the radius of the cavity to the height of the cavity).

The pump disclosed in WO2009/112866 has a substantially cylindrical cavity comprising a side wall closed at each end by an end wall. The pump also comprises an actuator that drives one or both of the end walls to oscillate in a direction substantially perpendicular to the surface of the plane of the end walls. The spatial profile of the motion of the driven end wall is described in WO2009/112866 as being matched to the spatial profile of the fluid pressure oscillations within the cavity, a state described therein as mode-shape matching. When the pump is mode-shape matched, work done by the actuator on the fluid in the cavity adds constructively across the driven end wall surface, thereby enhancing the amplitude of the pressure oscillation in the cavity and delivering improved pump efficiency. In a pump which is not mode-shape matched, there may be areas of the end wall wherein the work done by the end wall on the fluid reduces rather than enhances the amplitude of the fluid pressure oscillation in the fluid within the cavity. Thus, the useful work done by the actuator on the fluid is reduced and the pump becomes less efficient. The efficiency of a mode-shape matched pump may be dependent upon the interface between the driven end wall and the side wall. It is desirable to maintain the efficiency of such a pump by structuring this interface so that it does not significantly decrease or dampen the motion of the driven end wall thereby mitigating any reduction in the amplitude of the fluid pressure oscillations within the cavity.

Mode-shape matching the spatial profile of the displacement of the driven end wall to the spatial profile of the pressure oscillations of the fluid is preferable for efficient operation of the fluidic pump disclosed in WO2006/111775. FIGS. 3A and 3B of WO2006/111775 show the spatial profiles, referred to herein as modes, of the driven end wall for preferred embodiments of such a pump. FIG. 3A of WO2006/111775 shows an axisymmetric mode. Herein, axisymmetric is taken to mean having infinite order rotational symmetry, or equivalently being cylindrically symmetric, about the axis normal to and passing through the centre of the end walls of the cavity. For objects which do not have an obvious geometric centre, the term centre herein refers to the centre of mass of the object. Any object, group of objects or mode of oscillation which does not have this property is referred to herein as axially asymmetric. The axisymmetric mode shown in FIG. 3A of WO2006/111775 has maximum amplitude at the centre decreasing continuously to a minimum at the edge.

FIG. 3B of WO2006/111775 shows an axisymmetric mode where the displacement of the end wall is described by a Bessel function as further described therein. In this case, as the centre of the driven end wall 12 moves away from the opposite end wall 13, the outer portion of the driven end wall 12 is caused to move towards the opposite end wall 13. The modes of oscillation of the end walls in both of the above cases are matched to natural modes of acoustic oscillation of the cavity. Both of these modes show an antinode in the pressure oscillation localised at a single point, herein described as a point-antinode, at the centre of the cavity. The large pressure amplitude at this position makes it an ideal position for an aperture into the cavity with a valve, herein referred to as a valved aperture, operating as an inlet or outlet.

It is desirable to increase the pneumatic output of such a pump by increasing its pressure or flow capability. This would increase the range of applications that the pump is suitable for. The frequency of the fundamental-mode pressure oscillation of the cavity decreases with increasing area of the cavity end walls so the pump's performance cannot be improved simply by increasing its size without compromising the pump's valuable property of silence in the frequency range audible to humans.

One solution is to increase the diameter of the central valved aperture 16 of a pump of the type shown in FIG. 1 of WO2006/111755 WO2006/111775 while maintaining the cavity 11 size. This can enable a reduction in the fluidic flow resistance of the valve, delivering improved performance. However, the magnitude of the pressure oscillation can decrease rapidly with distance from the centre of the cavity, reducing the effectiveness of this solution.

A second solution is to mount two central valves 316 and 16, one in each end wall 12 and 13, as shown in FIG. 9A of GB1001740.8 WO2011/095795. Both valves benefit from being mounted at the central point-antinode of the pressure oscillation and improved pump performance may therefore be obtained. However, this solution complicates the manufacture of such a pump. At least one of the end walls is required to be coupled to an actuator to generate a pressure oscillation in the fluid in the cavity. Attempting to mount a valve in an end wall that is coupled to an actuator may complicate the design of the actuator and the attachment of the valve to the end wall may incur significant additional manufacturing costs.

A third solution, applicable to the pump design described above wherein the pressure oscillation has the form of an axisymmetric Bessel function, is to mount a second valve at the outer edge of the cavity (at which in operation there exists a circular pressure antinode). In practise this design has several disadvantages. Firstly, due to the radial nature of the pressure oscillation this circular antinode has a lower pressure amplitude than the central point-antinode and therefore the rectified pressure delivered by the valve is lower. Secondly, a different design of valve may be required in order to best match the shape of the pressure antinode at the edge of the cavity. A second valve design could increase manufacturing costs. Finally, a more complex manifold may be required to channel the flow of fluid into or out of the pump.

SUMMARY

In the present invention the pump cavity is designed and driven such that a plurality of high-amplitude pressure point-antinodes is generated within the cavity, providing multiple favourable positions for valved apertures. In this manner the limitations of the prior art are overcome.

To provide increased flow relative to the pumps described in the prior art, two or more of these valved apertures may be configured to act in parallel (i.e. all inlets or all outlets) with unvalved apertures located at pressure nodes acting as an outlets or inlets respectively. To provide increased pressure difference the valved apertures may be configured to act in series, with both inlets and outlets being valved.

It will be evident to one skilled in the art that the presence of a plurality of high-amplitude pressure point-antinodes facilitates improvement of the pneumatic performance of the pump, as desired.

Therefore, according to the present invention, there is provided a fluid pump comprising:

- a side wall closed at each end by an end wall forming a cavity for, in use, containing a fluid;
- one or more actuators each operatively associated with one or more of the end walls to cause an oscillatory motion of the associated end wall(s) whereby, in use, these axial oscillations of the end wall(s) drive radial oscillations of the fluid pressure in the cavity;
- two or more apertures into the cavity;
- a valve disposed in at least one of the apertures;
- wherein the actuator(s) is axially asymmetric such that, in use, a pressure oscillation with at least one nodal diameter is generated within the cavity.

The actuator may include axially asymmetric features and also may include a piezoelectric layer.

The axial asymmetry of the actuator may be defined by sections of the piezoelectric layer having different polarity.

The actuator preferably includes at least two electrodes. The axial asymmetry may be defined by separate electrodes and/or the absence of an electrode. At least one of the electrodes may be non-coaxial relative to the actuator. By "non coaxial", we mean that the longitudinal axis of the electrode(s) is different to that of the actuator itself.

Additionally or alternatively, a plurality of electrodes may be provided in a regular pattern which is non-coaxial relative to the actuator.

The actuator may include a piezoelectric layer which is non-coaxial relative to the cavity.

The pump may further include a voltage generator for generating one or more drive signals for supply to the actuator. The drive signal(s) generated by the electrical drive circuit may cause generation of non-axisymmetric motion of the actuator.

The actuator may contain at least one elliptical element, which may be a piezoelectric element or may be an electrode or both.

The actuator may cause a pressure oscillation with a plurality of nodal diameters to be generated.

The end wall motion is preferably mode-shape matched to the pressure oscillations in the cavity.

The frequency of the oscillatory motion is preferably within 20% of a resonant frequency of the substantially radial pressure oscillations in the cavity.

In use, the frequency of the oscillatory motion is preferably equal to a resonant frequency of the substantially radial pressure oscillations in the cavity.

The cavity of the pump is preferably substantially circular or elliptical.

The pump may further contain at least two apertures including at least one inlet aperture and at least one outlet aperture. In use, the pressure oscillations of the fluid in the cavity preferably cause fluid to flow from one or more of the inlet apertures to one or more of the outlet apertures.

The frequency of pressure oscillations in the cavity is preferably greater than 500 Hz.

The frequency of radial pressure oscillations in the cavity is more preferably greater than 19,000 Hz.

The ratio of the radius of the cavity (a) to the height of the side wall (h) is preferably greater than 1.7.

The radius of the cavity (a) and the height of the side wall (h) preferably satisfy the relationship $$\frac{h^2}{a} > 3\times10^{-10}$$

metres.

A pair of pumps may be provided, wherein the two pump cavities are separated by a common end wall. The common cavity end wall may be formed by an actuator.

Other objects, features, and advantages of the illustrative embodiments are described herein and will become apparent with reference to the drawings and detailed description that follow.

DETAILED DESCRIPTION OF ILLUSTRATIVE EMBODIMENTS

In the following detailed description of several illustrative embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
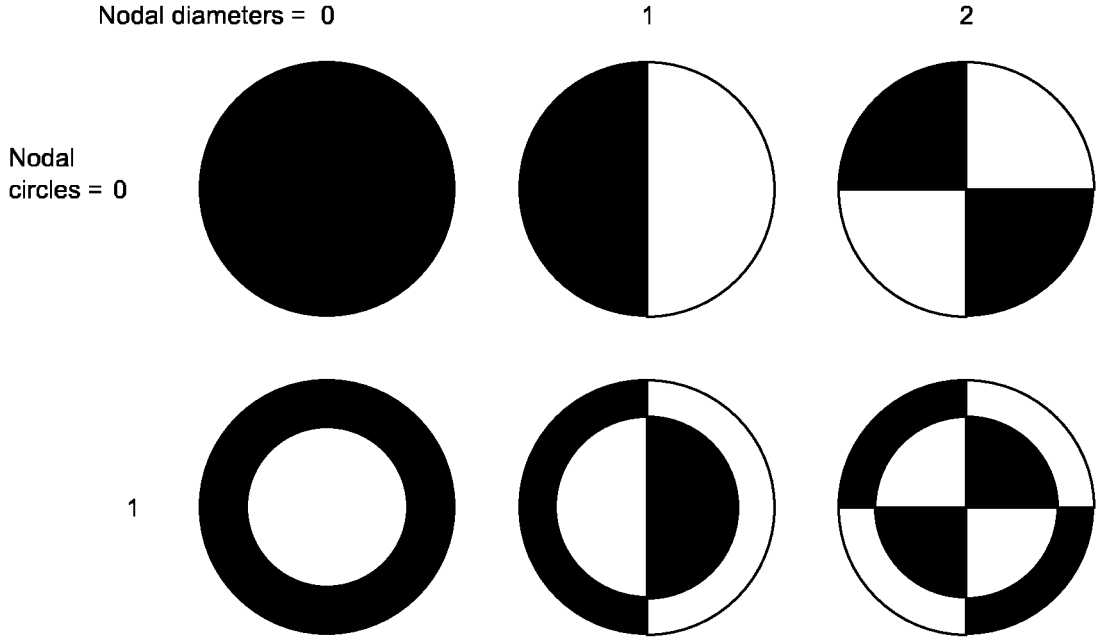
FIG. 1 shows the sign of the radial mode shapes of pressure oscillations in a cylindrical cavity.

FIG. 1 shows six radial modes for fluidic pressure oscillations in a cylindrical cavity. The black regions of the mode shapes shown in FIG. 1 represent regions of pressure difference (relative to the mean cavity pressure) having one sign, while the white regions represent pressure difference having the opposite sign. FIG. 1 represents the pressure distribution in the cavity at a point in time: in operation the signs of the pressure differences will oscillate from positive to negative.

Note that the term 'radial mode' is used herein to describe the spatial profile of a pressure oscillation in the plane of the end walls of the cavity having little or no variation perpendicular to the end walls. This phrase is intended to apply to modes in both circular and near-circular cavities, including elliptical cavities. As the deviation from a circular end wall becomes more pronounced, so will the mode shape deviate from what is shown in FIG. 1.

Radial modes of a cavity of circular cross section are characterised by the number of nodal diameters, j, and nodal circles, k, within each mode shape. A nodal diameter is a line that bisects the cavity along which there is little or no change in the pressure of the fluid in the cavity. A nodal circle is a circular line at constant cavity radius along which there is little or no change in the pressure of the fluid in the cavity.

Note that the term "nodal diameter" as used herein is intended to include not only a true diameter, i.e. passing through the centre of a cavity of circular cross section, but also similar paths, straight or curved, that start at one point on the perimeter of the cavity and finish at a second point along which there is no change in the pressure. The term "nodal circle" as used herein is similarly intended to include other substantially circular paths, such as ellipses.

Figure 2:
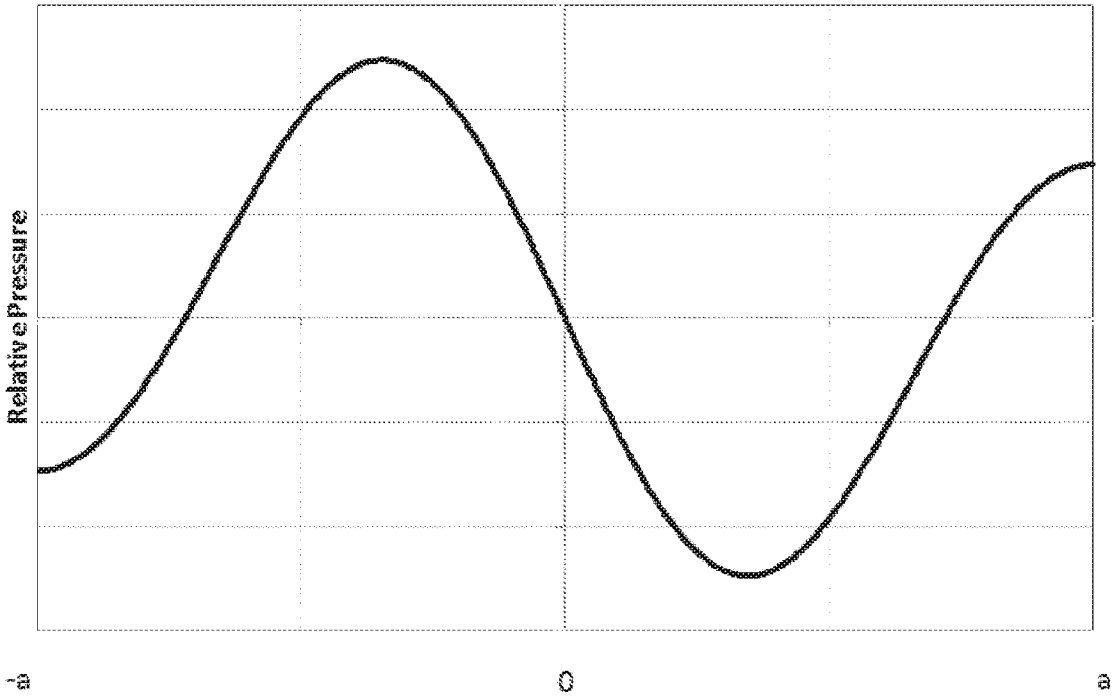
FIG. 2 shows a plot of the relative pressure along a line perpendicular to the nodal diameter of a pressure oscillation with radial mode j=1, k=1 in a cylindrical cavity.

Modes with one or more nodal diameters have multiple point-antinodes which are favourable positions for the location of valved apertures. For example, FIG. 2 shows a plot of the relative pressure along a line perpendicular to the nodal diameter of a pressure oscillation with radial mode j=1, k=1 in a cylindrical cavity. The pressure oscillation along this path, p(r), approximates the form of the Bessel function:

$$p(r) = J_1\left(\frac{k_1 r}{a}\right);$$

$$k_1 \approx 5.33.$$

This cross section shows two point-antinodes at −0.35a and +0.35a respectively, where a is the cavity radius.

For a cylindrical cavity the orientation with respect to the cavity of modes where j>1 is not fixed by the geometry of the cavity. This would make disposal of valves at point-antinodes problematic as the locations of these antinodes could not be predicted. The present invention solves this problem by designing the pump in such a way as to break the axial symmetry of these modes, thereby fixing the positions of the point-antinodes. This allows valved apertures to be disposed in predetermined locations at which pressure antinodes will be formed in operation, thereby enabling the improvements in pneumatic performance discussed above. Furthermore, because the size and shape of each point-antinode may be similar, the design of all of the valves may be the same, reducing costs in manufacture.

The resonant frequency of a radial mode of a pressure oscillation in a given cavity increases with the number of nodal diameters of that mode, and decreases with increasing cavity radius. These two factors may be balanced such that a larger cavity can be used while maintaining the frequency of operation of the pump above that which is audible to humans. This is advantageous as larger cavities can enable greater pneumatic performance without significantly increasing the cost of manufacture. Increasing pneumatic performance while maintaining cost increases the range of commercial applications viable with this pump.

Cavity Geometry

The present invention, as with the pump disclosed in WO2006/111775, may be described as possessing a substantially disk shaped cavity. In operation the pump generates radial acoustic pressure oscillations. In particular, when the cavity radius a is greater than 1.7 times the height h of the cavity, i.e.

$$\frac{a}{h} > 1.7,$$

the radial mode j=1, k=1 has a lower frequency than the any longitudinal modes of the cavity. For cavities with non-circular end walls, for example elliptical cavities, a may be approximated by an equivalent radius:

$$a = \sqrt{\frac{A}{\pi}}$$

where A is the area of the end wall.

To avoid inefficient operation resultant from high viscous losses in the fluid in the cavity the height of the cavity should be at least twice the thickness of the viscous boundary layer in the fluid:

$$h > 2\sqrt{\frac{2\mu a}{\rho k_1 c}};$$

$$k_1 \approx 5.33$$

where μ is the viscosity of the fluid, ρ is the density of the fluid, c is the speed of sound in the fluid and $k_1$ is the wave number of the Bessel function j=1, k=1. Rearranging the above expression and substituting in appropriate values for density and viscosity, $$\frac{h^2}{a}$$

should be greater than $3\times10^{-10}$ m when pumping a liquid and greater than $8\times10^{-8}$ m in the case of pumping a gas.

Axially Asymmetric Actuators

One method of breaking the axial symmetry of the pressure oscillations and thereby fixing the positions of the point-antinodes is to drive the oscillations in the cavity with an actuator that generates axially asymmetric motion. If the mode shape of an axially asymmetric displacement oscillation of the actuator substantially matches the mode shape of an axially asymmetric pressure oscillation in the cavity then this pressure oscillation will be excited with its orientation in the plane of the cavity fixed by the asymmetry of the actuator. By aligning the orientation of the actuator to the cavity during manufacture, the positions of the pressure point-antinodes, and thus the preferable locations of the valved apertures, are also fixed.

An actuator capable of generating axially asymmetric motion must itself have some feature of axial asymmetry. That is, there is some variation in the structure of the actuator along at least one path described by a circle that lies in the plane of the actuator and is centred on the axis normal to and passing though the centre of the end walls of the cavity. For clarity, such axial asymmetry may be embodied in the material(s) that make up the actuator (including any isolator as defined in PCT/GB 09/50613), any active elements such as piezoelectric materials (including state of polarisation), or any conductive materials deposited on the actuator as electrodes.

In a preferred embodiment, an actuator whose active element is a disc of piezoelectric material drives the oscillatory motion of an end wall. Because the manufacture of an axially asymmetric disc of piezoelectric material may be economically inefficient, axial asymmetry in the driving oscillation is introduced by the application of voltage to the piezoelectric disc via axially asymmetric electrodes. These electrodes are patterned to drive axially asymmetric oscillatory motion in the end wall and thereby generate an axially asymmetric pressure oscillation in the cavity. This approach may define the location of the point-antinodes without substantially increasing the cost of manufacture of the actuator. Preferred embodiments of pumps with axially asymmetric patterned electrodes are shown in FIGS. 4, 5 and 6.

In a second preferred embodiment, also including an actuator whose active element is a disc of piezoelectric material, axial asymmetry is introduced by the pattern of polarisation of the piezoelectric disc. The polarisation of a piezoelectric material is a physical property that governs the material's response to an applied electric field. A material polarised in one direction may expand in that direction under an applied electric field; an oppositely polarised material would contract under the same conditions. Inducing axially asymmetric polarisation in an actuator can enable axially asymmetric displacement of the actuator in operation. A preferred embodiment of a pump having an axially asymmetric polarised piezoelectric disc is shown in FIG. 7.

In a third preferred embodiment the axial asymmetry of the displacement oscillation of the actuator is generated by the axially asymmetric placement of one or more discrete piezoelectric elements. In a more preferred embodiment these piezoelectric elements are positioned such that there is substantial mode-shape matching between the displacement oscillation generated in the actuator and some part of an axially asymmetric mode of the pressure oscillation generated in the fluid in the cavity. Preferred embodiments of pumps with actuators with axially asymmetric placement of piezoelectric elements are shown in FIG. 8.

Axially Asymmetric Cavities

Figure 3:
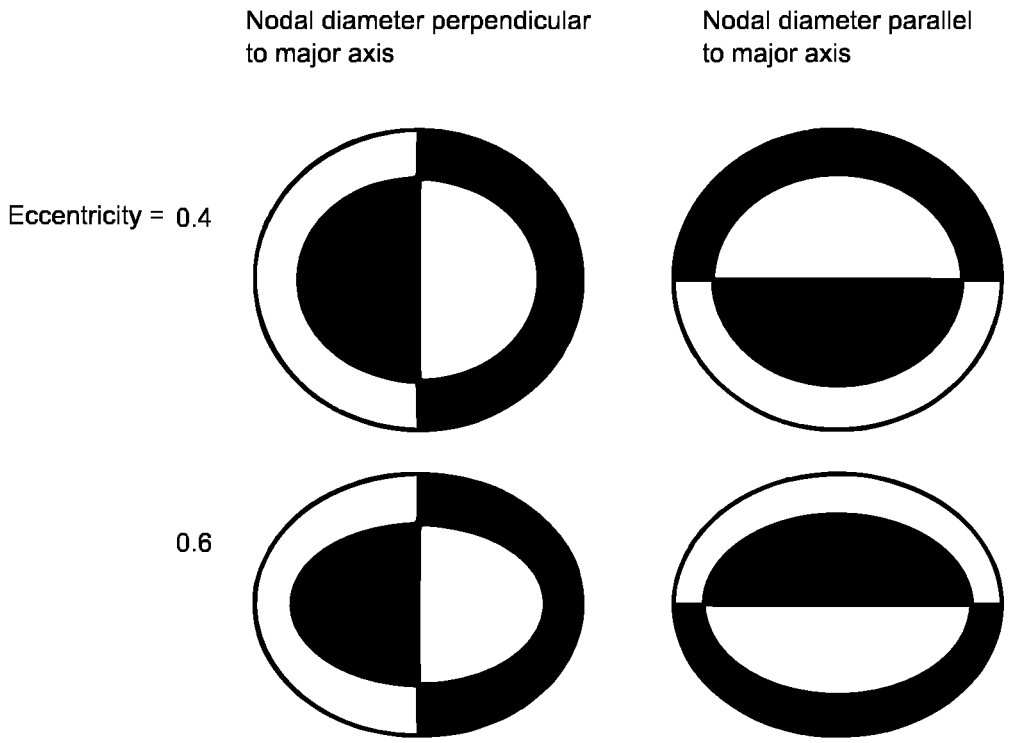
FIG. 3 shows the sign of the radial mode shapes of pressure oscillations in a cylindroid cavity of elliptical cross section.

A further method of defining the antinodal positions is by selecting a cavity shape that does not show axial symmetry. A preferable arrangement would be to construct the cavity with elliptical end walls. Such a cavity shows radial pressure oscillation modes broadly similar to those observed in a cavity with circular end walls, with increased distortion to the mode shapes occurring at higher values of eccentricity. The mode j=1, k=1 for cavities with end walls of eccentricity 0.4 and 0.6 is shown in FIG. 3.

Due to the axial asymmetry in such a cavity, the angular orientations of pressure modes are fixed relative to the cavity. For example, for the j=1, k=1 modes shown in FIG. 3 the nodal diameter can be either parallel or perpendicular to the major axis of the ellipse depending on which one of two distinct modes is excited. These two modes in question have differing resonant frequencies so can be excited selectively. Therefore the axial asymmetry of the cavity defines the position of the point-antinodes relative to the cavity enabling facile placement of apertures and valves at these positions. This is distinct from the case of a cavity having circular end walls where only the actuator can define the orientation of the axially asymmetric pressure oscillation. An elliptical cavity has the benefit that it may not be necessary to align the actuator with the cavity in production.

Figure 10:
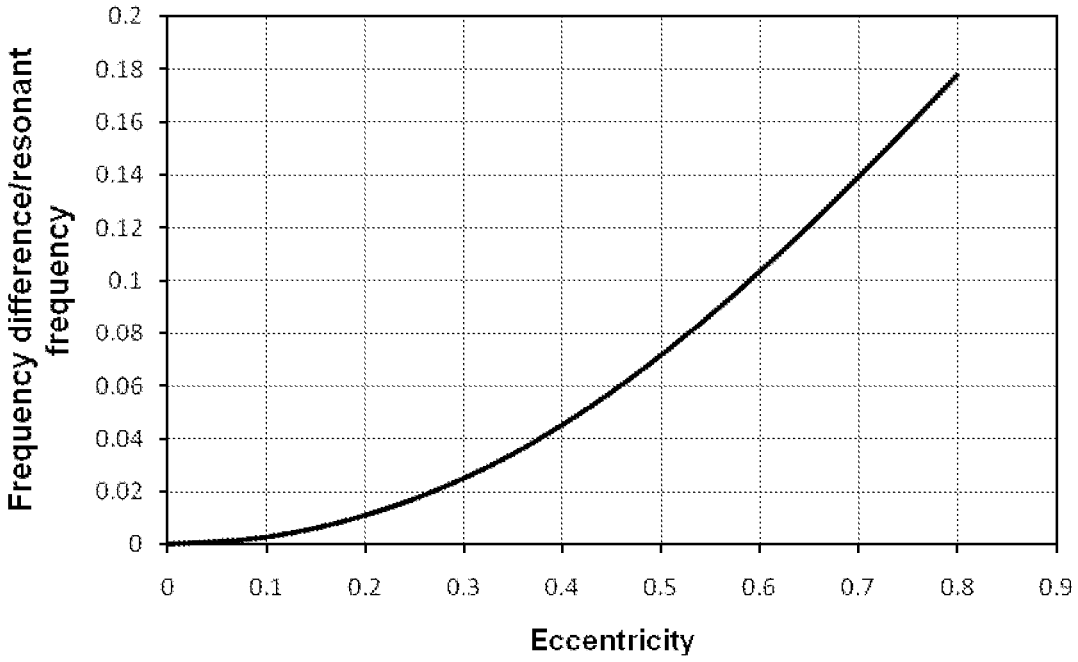
FIG. 10 shows a plot of the difference in resonant frequency between the parallel and perpendicular orientations of the mode j=1, k=1 in a cylindroid cavity with increasing eccentricity.

The difference in resonant frequency of the parallel and perpendicular orientations of the mode j=1, k=1 with eccentricity are shown in FIG. 10. It is worth noting that for the design of a practical pump the value of the eccentricity need not be large to achieve a frequency splitting sufficient to permit facile selective excitation of one of the two orientations of the above mode, the cavity can remain substantially circular.

In one embodiment of the present invention, the pressure oscillations are generated using an elliptical actuator. This actuator could be an elliptical piezoelectric device. Such a device could generate a displacement oscillation that would produce a mode shape that matches the desired mode shape of the cavity.

In another embodiment of the present invention pressure oscillations are generated with a circular or semi circular actuator coupled to the elliptical cavity by a compliant membrane of the type disclosed in PCT/GB 09/50613. In a preferred embodiment this actuator would be a circular or semicircular piezoelectric device. This has the commercial benefit that these devices are inexpensive compared to more unusual geometries such as ellipses. This would have the disadvantage of imperfect mode-shape matching between the circular actuator and the elliptical cavity.

An advantage of using an elliptical cavity over a circular cavity is an increase in the separation of the point-antinodes. This may simplify the manufacture and assembly of the valves and pump.

Illustrated Preferred Embodiments

FIG. 4 shows a schematic representation of a pump 10 according to the present invention. A cavity 11 is defined by end walls 12 and 13, and a side wall 14. The cavity is substantially circular in cross section as drawn, but other suitable shapes such as elliptical could be used. The cavity 11 is provided with one or more nodal air inlets 15, which in this example are shown as unvalved. There are also two valved air outlets 16 located at point-antinodes. The first end wall 12 is partly defined by the lower surface of a disc 17 attached to the side wall 14 via a flexible membrane 30, this flexible membrane forming the remainder of the first end wall. In this case the side wall 14 and the second end wall 13 are defined by a single part, the pump body 18. The pump body may be formed from any suitable rigid material including metal, ceramic, glass, or plastic, and in a preferred embodiment is formed from injection-moulded plastic. In this embodiment air is drawn into the pump through air inlet(s) 15 and is pumped out through valved outlets 16. Other configurations are possible e.g. the valves 16 may be reversed such that they become air inlets and the air is pumped out through nodal air outlet(s) 15. A second pump 10', having a second pump cavity 11', is shown schematically in FIG. 4 as forming a pair of pumps with the pump 10. A common end wall 12', separating the pump 10 and the second pump 10', is shown schematically as disc 20.

The actuator comprises a piezoelectric disc 20 attached to a disc 17. When an appropriate electrical drive is applied, the actuator is caused to vibrate in a direction substantially perpendicular to the plane of the cavity. Electrical drive is applied by two separate conductive electrodes 21 and 22 and electrical connection to the disc 17 which is electrically conductive in this embodiment. This electrode arrangement generates axially asymmetric displacement oscillations in the actuator, which in turn generate axially asymmetric pressure oscillations within the fluid in the cavity.

Figures 4A, 4B, 4C, 4D:
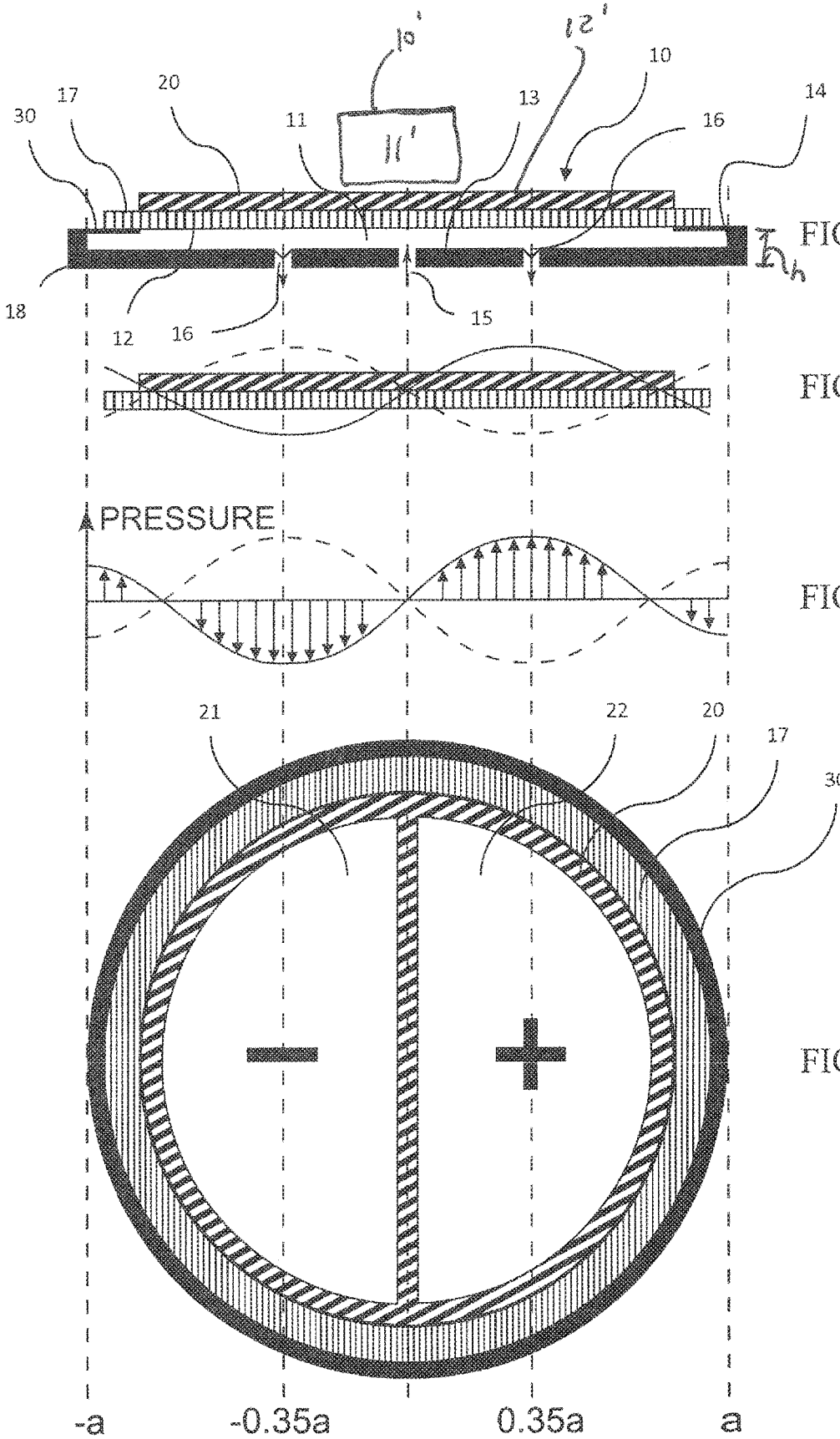
FIG. 4 shows a schematic cross-section view of a first pump according to an illustrative embodiment with two valved outlets operating in parallel and a nodal inlet, a graph of the displacement oscillations of the driven end wall of the pump, a graph of the pressure oscillations within the cavity of the pump and a schematic plan view of the pump.
Figure 5A:
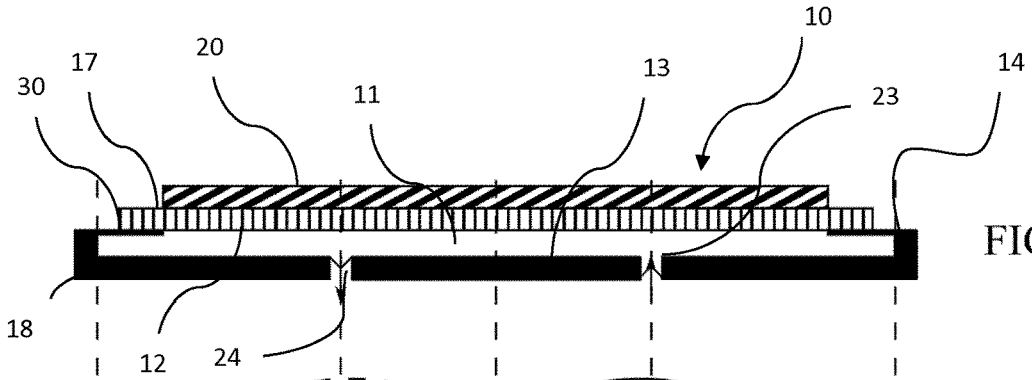
FIG. 5 shows a schematic cross-section view of a second pump according to an illustrative embodiment with two valved apertures operating in series, a graph of the displacement oscillations of the driven end wall of the pump, a graph of the pressure oscillations within the cavity of the pump and a schematic plan view of the pump.
Figure 5B:
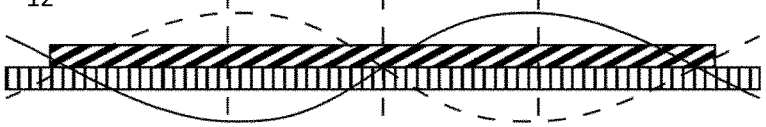
Figure 5C:
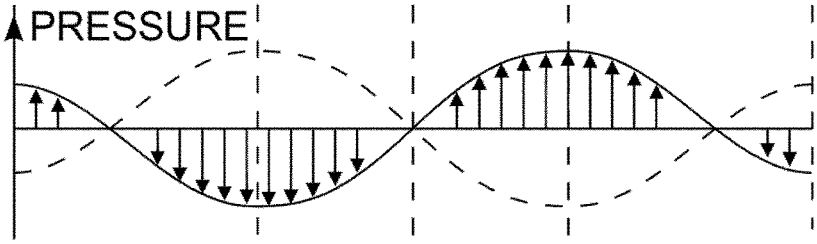
Figure 5D:
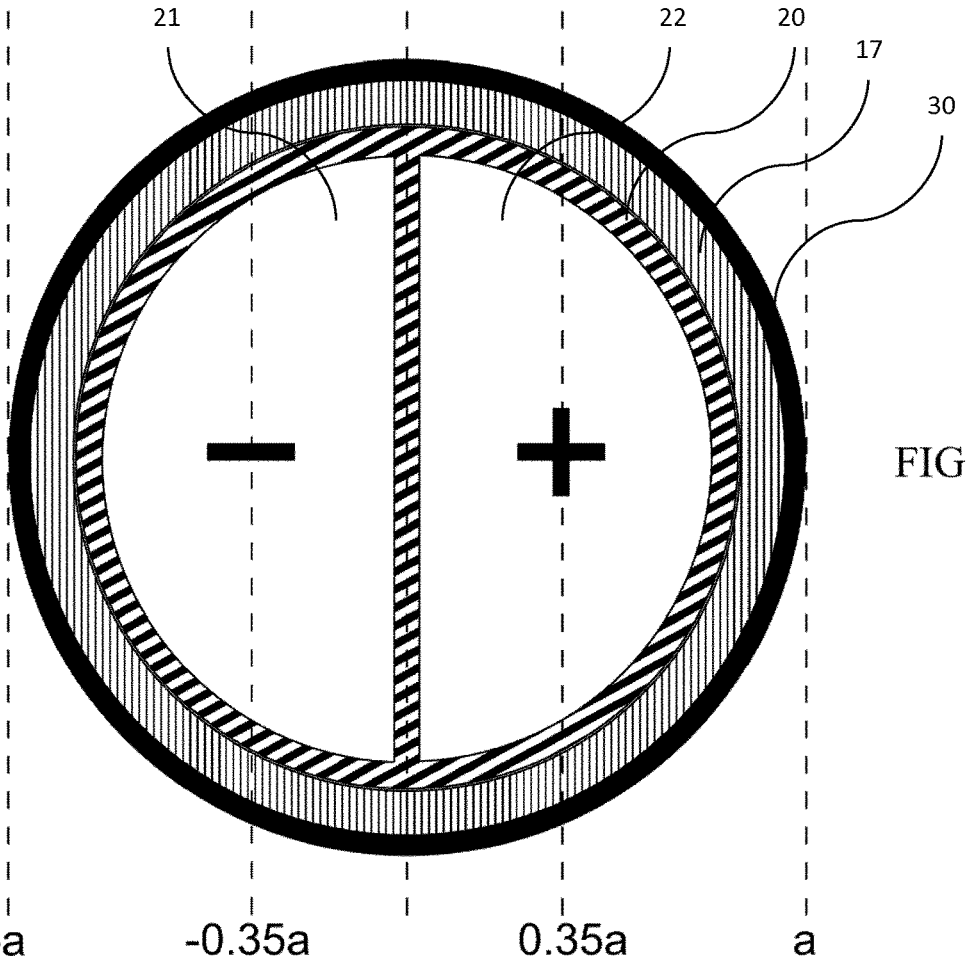

FIG. 4B shows the displacement profile of the driven wall 12 of the cavity along a line bisecting the cavity and perpendicular to the nodal diameter of the oscillation of the wall. The solid curved line and arrows indicate the wall displacement at one point in time, and the dashed curved line its displacement one half-cycle later. Note that the displacements as drawn in this figure and the other figures are exaggerated. Because of the axially asymmetric patterning of the electrodes 21 and 22 shown in FIG. 4D, the mode shape of the displacement of the actuator is also axially asymmetric. For the electrode configuration shown in FIG. 4D the mode shape of the actuator closely resembles the j=1, k=1 mode shape of the cylindrical cavity.

FIG. 4C shows the pressure oscillation profile for the cavity shown in FIG. 4A along a line bisecting the cavity and perpendicular to the nodal diameter of the oscillation. The solid curved line and arrows indicate the pressure at one point in time, and the dashed curved line the pressure one half-cycle later. The pressure oscillation along this path, p(r), approximates the form of the Bessel function:

$$p(r) = J_1\left(\frac{k_1 r}{a}\right);$$

$$k_1 \approx 5.33.$$

This oscillation has two point-antinodes at r≈−0.35a and r≈0.35a. The two valved apertures 16 are disposed at these positions.

FIGS. 4B and 4C show the modes of actuator displacement and pressure oscillation that are typically employed in the operation of the pump of FIG. 4A, and thereby illustrate an important aspect of the present invention: by patterning the electrodes to excite a particular displacement oscillation in the end wall 12 whose mode shape is well matched to an axially asymmetric mode shape of the cavity that possesses one or more nodal diameter, a pressure oscillation with multiple point anti-nodes can be efficiently generated. Furthermore, the patterning of the electrodes defines the orientation of the pressure oscillation with respect to the cavity, fixing the position of the point-antinodes. This allows the disposition of multiple valves within apertures in the cavity enabling a pump with greater pneumatic performance.

This embodiment of the present invention therefore enables good mode-shape matching to be obtained between actuator oscillation and an axially asymmetric pressure oscillation in the cavity. The resulting pump may deliver greater pneumatic performance without significantly increased cost.

FIG. 5 shows a schematic representation of a pump similar in design to that of FIG. 4, but differing in its arrangement of inlets and outlets. The pump presented in FIG. 4 possesses two valved outlets 16 operating in parallel. In that embodiment air is pumped from nodal inlet(s) 15 to valved outlets 16. The pump presented in FIG. 5 has a valved inlet 23 and a valved outlet 24. As in the embodiment described in FIG. 4 both valved apertures are disposed at point anti-nodes of the pressure oscillation in the cavity; however, there are no nodal apertures in the embodiment presented in FIG. 5. A pump having this series arrangement of valved apertures is capable of higher pressures than the pump presented in FIG. 4, at the cost of reduced flow rate of fluid through the pump.

Figure 6A:
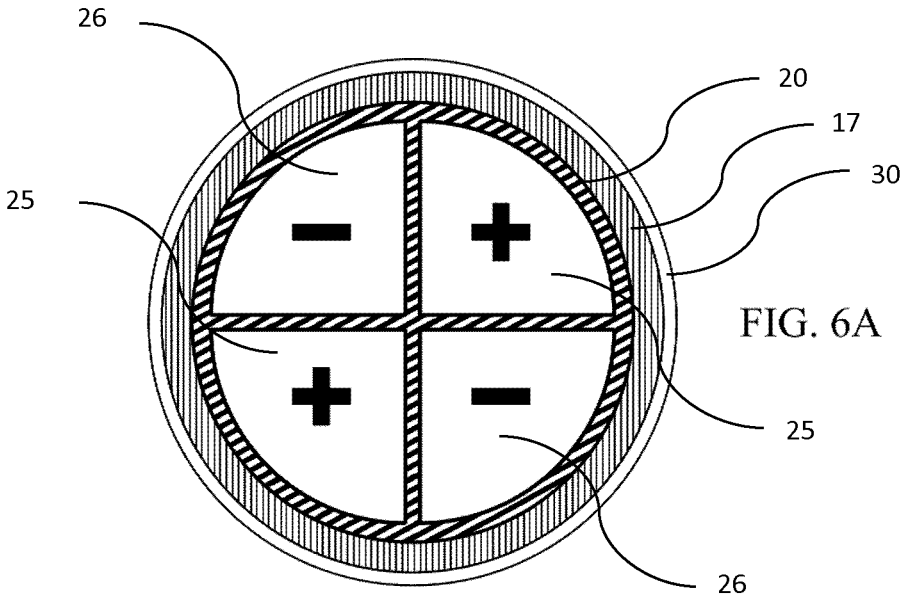
FIG. 6 shows a schematic plan view of a third pump according to an illustrative embodiment with four valved apertures and four separate electrodes, a schematic plan view of a fourth pump according to an illustrative embodiment with four valved apertures and an alternative electrode configuration, and a representation of the mode shape of the resultant pressure oscillation in the cavity of the two above pumps with the preferred positions of valved apertures marked.
Figure 6B:
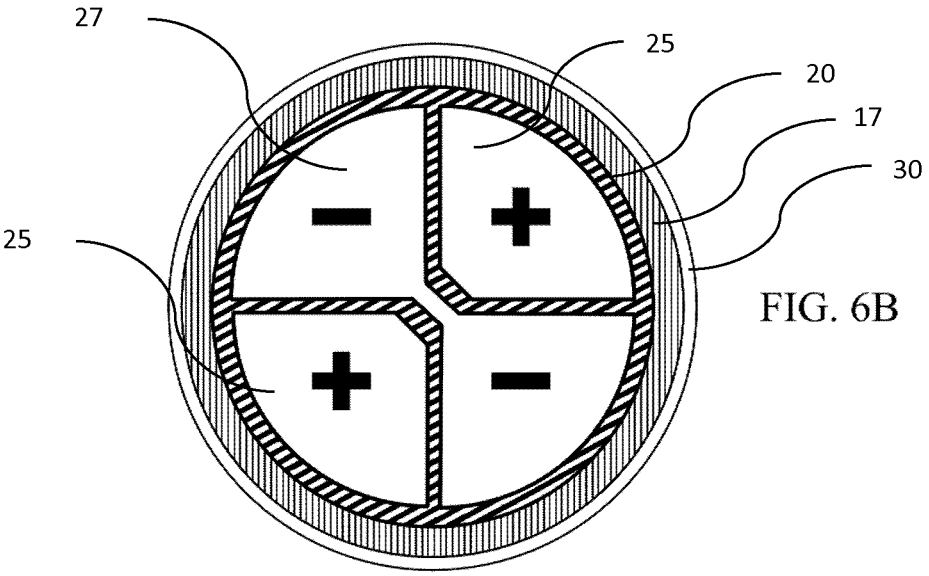
Figure 6C:
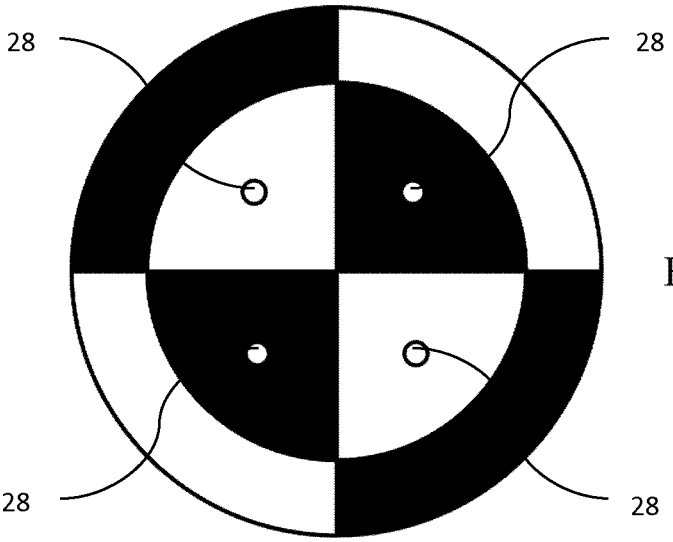

FIG. 6 shows two embodiments of the present invention in which four point-antinodes are generated in the fluid oscillation in the cavity. FIG. 6A shows a plan schematic view of a pump with four separate electrodes. Two electrodes electrically driven with a common phase 25 and a further two driven 180° out of phase with the first two 26. This configuration will generate a pressure oscillation of the mode j=2, k=1 in the cavity, shown in FIG. 6C, and can deliver good mode-shape matching between actuator displacement and cavity pressure. FIG. 6B shows a plan view schematic representation of a pump that also generates the pressure oscillation shown in FIG. 6C but using an alternative electrode configuration. Here a single electrode 27 replaces two of the common phase electrodes 26 in the design disclosed in FIG. 6A. This example illustrates that it is the axially asymmetric field across the piezoelectric disc that is of paramount importance for this embodiment, this field can be generated by any number of similar electrode configurations. FIG. 6C also shows the approximate positions of the point antinodes 28 of the pressure oscillation and hence the preferred valved aperture positions.

Figure 7A:
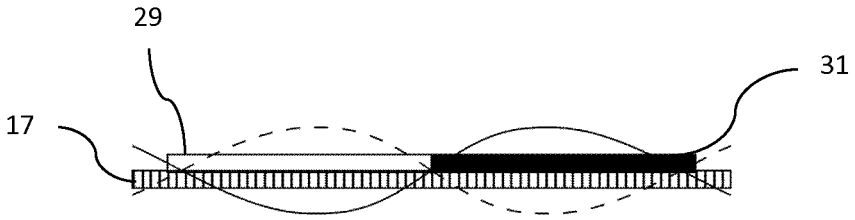
FIG. 7 shows a graph of the displacement oscillations of the driven end wall according to a fifth embodiment, a schematic plan view of the pump showing the polarisation of the piezoelectric disc, and a representation of the mode shape of the resultant pressure oscillation in the cavity of the pump with the preferred positions of valved apertures marked.

FIG. 7 shows a pump wherein different regions of the piezoelectric disc are oppositely polarised to introduce axial asymmetry into the motion of the actuator. FIG. 7A shows the displacement profile of the driven wall 12 of the cavity along a line bisecting the cavity and perpendicular to the nodal diameter of the oscillation of the wall. The solid curved line and arrows indicate the wall displacement at one point in time, and the dashed curved line its position one half-cycle later.

Figure 7B:
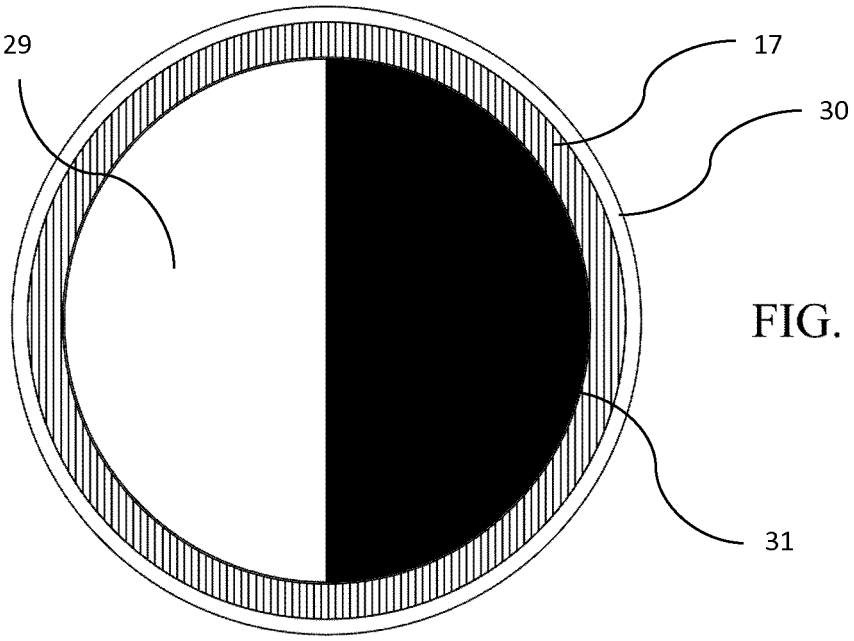

The piezoelectric disc is divided into two regions of opposite polarisation 29 and 31. FIG. 7B shows a plan schematic view that illustrates the extent of these regions of opposite polarisation.

Figure 7C:
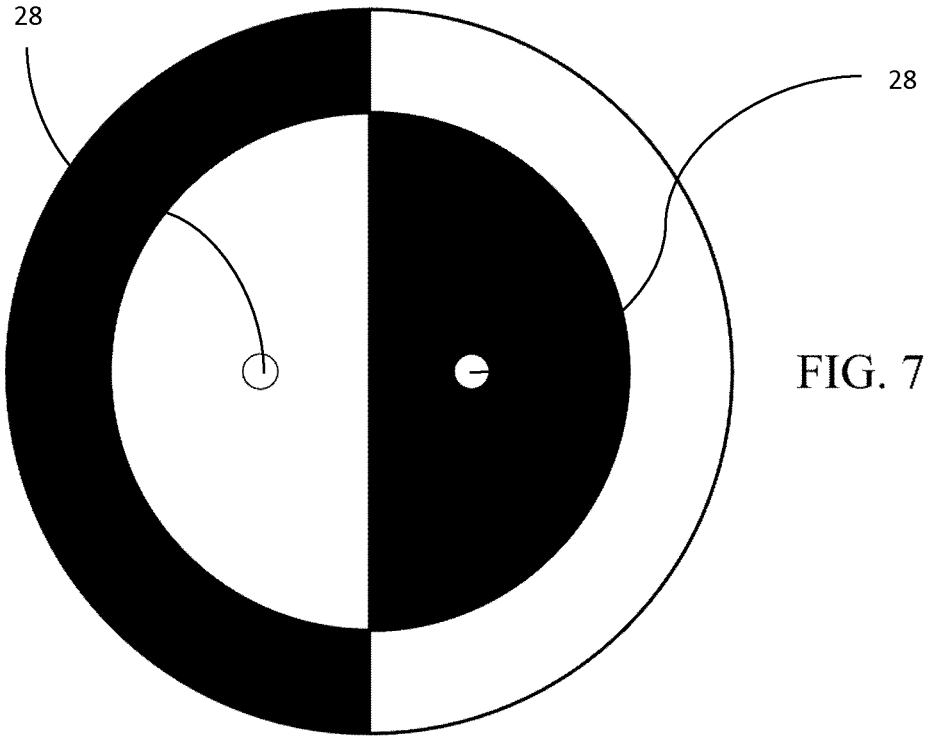

Because of the axially asymmetric polarisation of the piezoelectric disc, the mode shape of the displacement of the actuator is also axially asymmetric. For the polarisation configuration shown in FIG. 7B the mode shape of the actuator closely resembles the j=1, k=1 mode shape of the cylindrical cavity. This leads to the generation of a pressure oscillation of this mode in the cavity and good mode-shape matching between the two. The mode shape generated is shown in FIG. 7C, along with the approximate positions of the point antinodes 28 of the pressure oscillation and hence the most preferred valved aperture positions.

It is worth noting that generating axially asymmetric actuator motion by patterning the polarisation of the piezoelectric disc allows the use of an axially symmetric electrode for the pump. The polarisation could be applied during manufacture of the piezoelectric disc using a temporary axially asymmetric electrode. This has advantages for fabrication of the pump as it simplifies the electrical connections to the actuator.

Figure 8A:
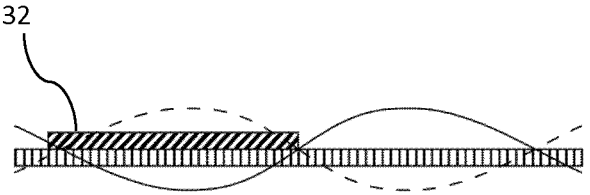
FIG. 8 shows a graph of the displacement oscillations of the driven end wall according to a sixth embodiment, a schematic plan view of the pump showing the extent of the piezoelectric disc, and a representation of the mode shape of the resultant pressure oscillation in the cavity of the pump with the preferred positions of valved apertures marked.

FIG. 8 discloses a pump wherein the actuator is coupled to a piezoelectric element which extends over a region which is not axially symmetric with the cavity. FIG. 8A shows the displacement profile of the driven wall 12 of the cavity along a line bisecting the cavity and perpendicular to the nodal diameter of the oscillation of the wall. The solid curved line and arrows indicate the wall displacement at one point in time, and the dashed curved line its position one half cycle later.

Figure 8B:
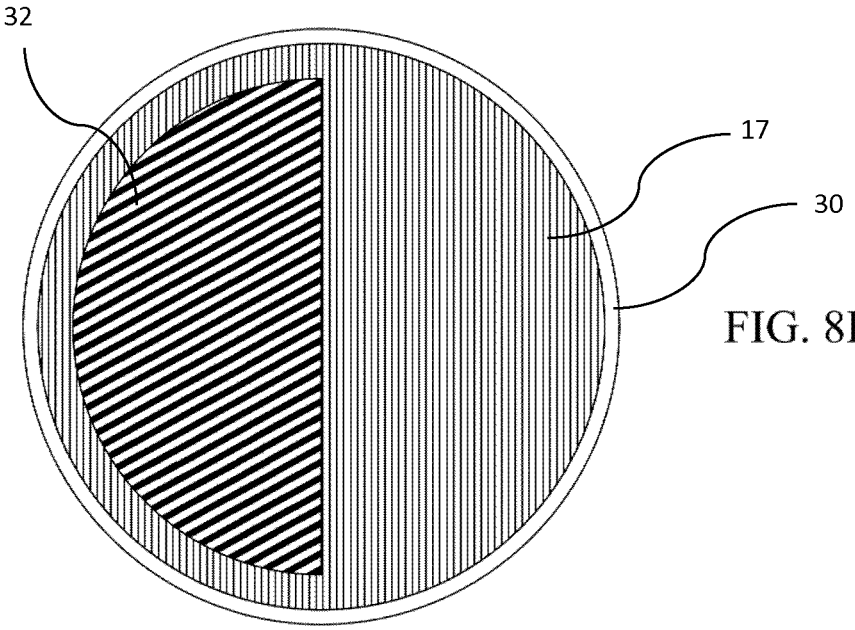
Figure 8C:
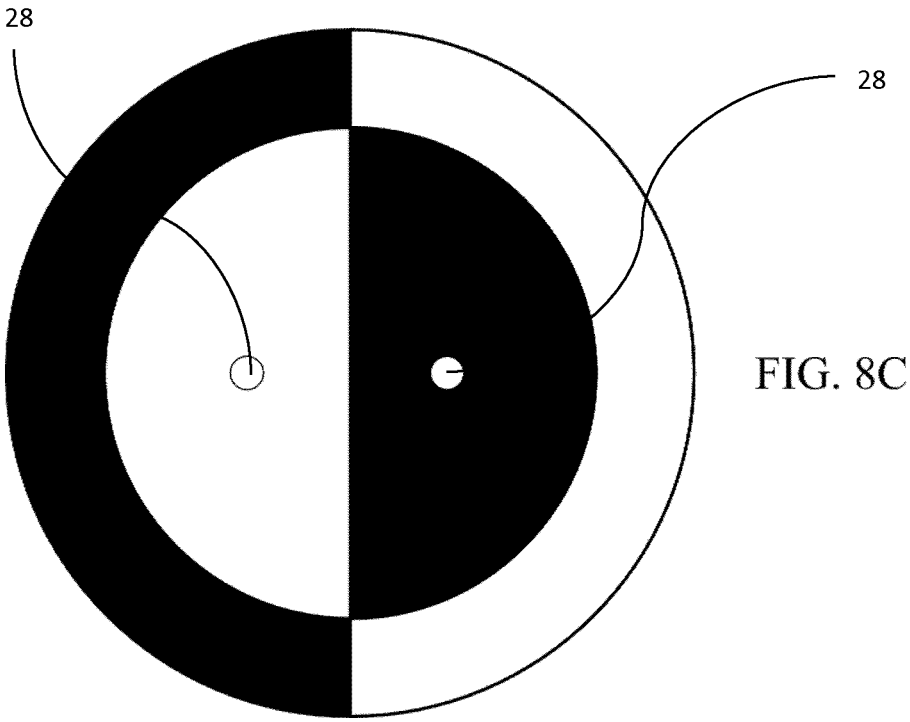

FIG. 8B shows a plan schematic view that illustrates the extent of the piezoelectric disc 32. Because of the axially asymmetric extent of the piezoelectric disc, the mode shape of the displacement of the actuator is also axially asymmetric. For the configuration shown in FIG. 8B the mode shape of the actuator resembles the j=1, k=1 mode shape of the cylindrical cavity. This leads to the generation of a pressure oscillation of this mode in the cavity and good mode-shape matching between the two. The mode shape generated is shown in FIG. 8C, along with the approximate positions of the point antinodes 28 of the pressure oscillation and hence the most preferred valved aperture positions.

This embodiment has the advantage of reducing the amount of piezoelectric material required to fabricate a pump operating on the principle of axially asymmetric pressure oscillation thus reducing the cost of said pump. This may be particularly suited to a pump where high pressure or flow was required, but efficiency was of secondary importance.

Figure 9A:
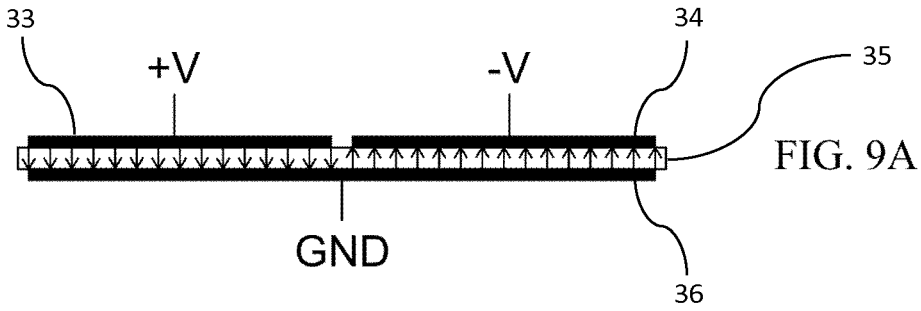
FIG. 9 discloses several different configurations of electrode(s) and piezoelectric disc suitable for generating axially asymmetric actuator motion.
Figure 9B:
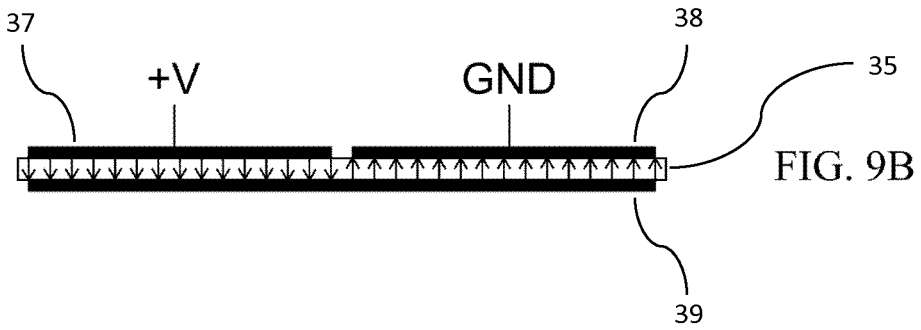

FIG. 9 discloses several different configurations of electrode(s) and piezoelectric disc suitable for generating axially asymmetric actuator motion. FIG. 9A shows a cross section through an actuator comprising two top electrodes 33 34 driven out of phase with one another and a bottom electrode 36 connected to ground sandwiching a piezoelectric disc with a single polarisation direction 35. In operation the electric field, marked on FIG. 9 by arrows, and the direction of polarisation will alternate between being parallel and anti-parallel to one and other. Due to the phase difference between the drive voltages applied to the two top electrodes, when one half is parallel, the other half will be anti-parallel. The motion induced will thus be opposite in each half of the actuator, breaking axial symmetry. FIG. 9B shows an alternative electrode configuration. Here the top electrodes are connected to an alternating voltage supply 37 and ground 38 respectively. In this configuration the bottom electrode 39 acts a common electrode and the two halves of the actuator are analogous to two capacitors in series. The operating mechanism is otherwise the same as that outlined above; however, this configuration allows connections to be made to the top surface of the actuator only which may be beneficial to production or reduce cost. The amplitude of the voltage required with this configuration is increased for a given actuator motion.

Figure 9C:
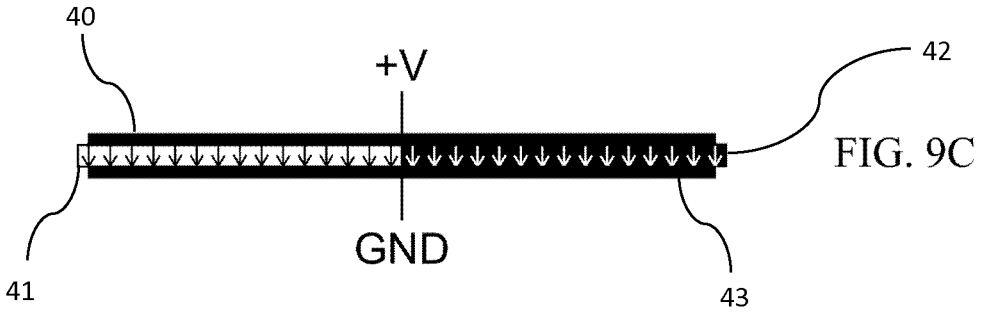

FIG. 9C shows a third design of actuator. Here, as disclosed in FIG. 7, the piezoelectric disc is bisected into two regions of opposite polarisation 41 42. In this case the piezoelectric disc is sandwiched between a single top electrode 40 connected to an alternating voltage and a bottom electrode connected to ground 42. The two halves of the actuator experience the same electric field; yet have opposite polarisations, generating the same axial asymmetry in motion observed in the actuator designs disclosed in FIG. 9A and FIG. 9B.

The invention claimed is:

1. A pump comprising:

a side wall closed at each end by an end wall forming a substantially circular or elliptical cavity for, in use, containing a fluid;

at least one actuator, each actuator operatively associated with one or more of the end walls to cause an oscillatory motion of the associated end wall(s) whereby, in use, these axial oscillations of the end wall(s) drive substantially radial oscillations of the fluid pressure in the cavity wherein a ratio of a radius of the cavity (a) to a height of the side wall (h) is greater than 1.7;

two or more apertures in the cavity; and a valve disposed in at least two of the apertures;

wherein the actuator(s) is/are arranged to be axially asymmetric such that, in use, a pressure oscillation with at least one nodal diameter is generated within the cavity, and the apertures in which a valve is disposed are located at antinodes of the pressure oscillation.

2. A pump according to claim 1, wherein the actuator(s) include(s) axially asymmetric features.

3. A pump according to claim 1, wherein the actuator(s) contain(s) at least one elliptical element.

4. A pump according to claim 1, wherein, in use, the actuator(s) causes a pressure oscillation with the nodal diameters(s) to be generated.

5. A pump according to claim 1, wherein the end wall motion is mode-shape matched to the pressure oscillations in the cavity.

6. A pump according to claim 1, wherein, in use, a frequency of radial pressure oscillations in the cavity is greater than 19,000 Hz.

7. A pump according to claim 1, wherein the radius of the cavity (a) and the height of the side wall (h) satisfy the relationship $$\frac{h^2}{a} > 3 \times 10^{-10}$$

metres.

8. A pump according to claim 1, wherein the actuator(s) include(s) a piezoelectric layer which is non-coaxial relative to the cavity.

9. A pump according to claim 1, wherein the actuator(s) include(s) a piezoelectric layer.

10. A pump according to claim 9, wherein an axial asymmetry is defined by sections of the piezoelectric layer having different polarisation.

11. A pump according to claim 1, further comprising an electrical drive circuit for generating one or more drive signals for supply to the actuator(s).

12. A pump according to claim 11, wherein the drive signal(s) cause generation of axially asymmetric motion of the actuator(s).

13. A pump according to claim 1, wherein, in use, a frequency of the oscillatory motion is within 20% of a resonant frequency of the substantially radial pressure oscillations in the cavity.

14. A pump according to claim 13, wherein, in use, the frequency of the oscillatory motion is equal to the resonant frequency of the substantially radial pressure oscillations in the cavity.

15. A pump according to claim 1, wherein the actuator(s) include(s) at least two electrodes.

16. A pump according to claim 15, wherein an axial asymmetry is defined by separate electrodes and/or an absence of an electrode.

17. A pump according to claim 15, wherein at least one of the electrodes is non-coaxial relative to the actuator(s).

18. A pump according to claim 15, wherein the electrodes are provided in a regular pattern which is non-coaxial relative to the actuator(s).

* * * * *